US005873747A

United States Patent [19]

Tsuji

[11] Patent Number: 5,873,747

[45] Date of Patent: Feb. 23, 1999

[54] CONNECTOR WITH LOCKING ARM

[75] Inventor: Takeshi Tsuji, Yokkaichi, Japan

[73] Assignee: Sumitomo Wiring Systems, Ltd., Japan

[21] Appl. No.: 748,402

[22] Filed: Nov. 13, 1996

[30] Foreign Application Priority Data

Nov. 20, 1995 [JP] Japan ..... 7-326597

[51] Int. Cl.[6] ..... H01R 13/627

[52] U.S. Cl. ..... 439/357

[58] Field of Search ..... 439/350, 353, 439/354, 357, 352

[56] References Cited

U.S. PATENT DOCUMENTS 4,984,998 1/1991 Duncan et al. .

4,986,766 1/1991 Leonard et al. ..... 439/354

5,624,272 4/1997 Ohsumi ..... 439/353

FOREIGN PATENT DOCUMENTS 0 660 451 A2 6/1995 European Pat. Off. .

1-119180 8/1989 Japan .

*Primary Examiner*—Hien Vu

*Assistant Examiner*—Yong Ki Kim

*Attorney, Agent, or Firm*—Banner & Witcoff, Ltd.

[57] ABSTRACT

One of a pair of electrical connectors has a resilient cantilevered locking arm 15 which has a finger plate 19 for release thereof. The finger plate is undercut on one side to accommodate a travel stop constituted by an upstanding sidewall 17. The other sidewall 16 extends to at least the upper surface of the arm 15 thereby resisting accidental release thereof. The arrangement permits the width of the connector to be reduced whilst giving better access to the finger plate 19.

4 Claims, 2 Drawing Sheets

CONNECTOR WITH LOCKING ARM

FIELD OF THE INVENTION

The present invention relates to a connector with a locking arm.

BACKGROUND TO THE INVENTION

As shown in FIG. 4 and FIG. 5 appended hereto, a conventional connector has a locking member 2 formed on its upper face for carrying out fitting and locking with a corresponding connector (not shown). This locking member 2 comprises a locking arm 3 that is capable of bending, and controlling walls 4 located on both sides thereof. The locking arm 3 is supported at one end and is capable of bending in an up-down direction. When male and female connectors (the connector 7 and the corresponding connector, which is not shown) are fitted correctly, the locking arm 3 fits with a portion of the corresponding connector and reaches a latched state. The free end of the locking arm 3 has a releasing member 5. When this is pressed down and the locking arm 3 thereby bent down, the locking arm 3 is released from the latched state to permit the connectors to be separated.

The controlling walls 4, formed so as to fit both sides of the locking arm 3 snugly, prevent electric wires from being trapped beneath the locking arm 3, and prevent the latch from being released in the event that the upper side of the connector is inadvertently pressed.

In the conventional case, in order to prevent the locking arm 3 from excessive bending when it is operated beyond its elastic limit, stopper members 6 project from the inner faces of both the controlling walls 4. When the locking arm 3 is bent through a given angle (in FIG. 5, this is the position shown by solid lines), the lower face of the releasing member 5 makes contact with the stopper member 6, making it impossible for the locking arm 3 to bend any further.

As described above, the controlling walls serve the important functions of preventing an external object from being trapped and of preventing the arm from being inadvertently operated from above. For this reason, when the width of the locking member is set, apart from the width of the locking arm, that of the controlling walls must also be taken into account. Since it is desirable for the connector to be miniaturized, the width of the locking member is also set to be as narrow as possible, but when operability is taken into consideration, it is hard to reduce the width of the locking arm beyond its current width. The spacing between the walls 4 must be sufficient for a finger of an operator to interpose therebetween. Consequently, in the current configuration the minimum dimension is the sum of the width of the releasing member 5 and that of the controlling walls 4. This is one of the factors that interfere with the miniaturization of the connector.

The present invention has been developed after taking into consideration this problem and aims at presenting a connector which can be miniaturized.

SUMMARY OF THE INVENTION

According to the invention there is provided a connector comprising a housing, a cantilever locking arm movable towards the housing against a resilient bias and adapted for locking engagement with a mating connector, and first and second upstanding sidewalls on either side of said locking arm, wherein the locking arm is undercut on one side thereof to define a recess, and one of said sidewalls lies at least partly within the recess for abutment with said arm. Such an arrangement permits the width of the connector to be reduced since one sidewall is within the undercut of the locking arm and also serves as a travel stop.

The other sidewall may extend to the upper level of the locking arm to prevent inadvertent release thereof.

Preferably the connector is moulded in one piece from a resilient plastics material. Preferred embodiments of the invention are described in the appended claims.

BRIEF DESCRIPTION OF THE DRAWINGS

Other features of the invention will be apparent from the following description of a preferred embodiment in which.

DESCRIPTION OF PREFERRED EMBODIMENT

An embodiment of a connector with a locking arm in accordance with the present invention will now be described, with reference to FIGS. 1 to 3.

Figure 1:
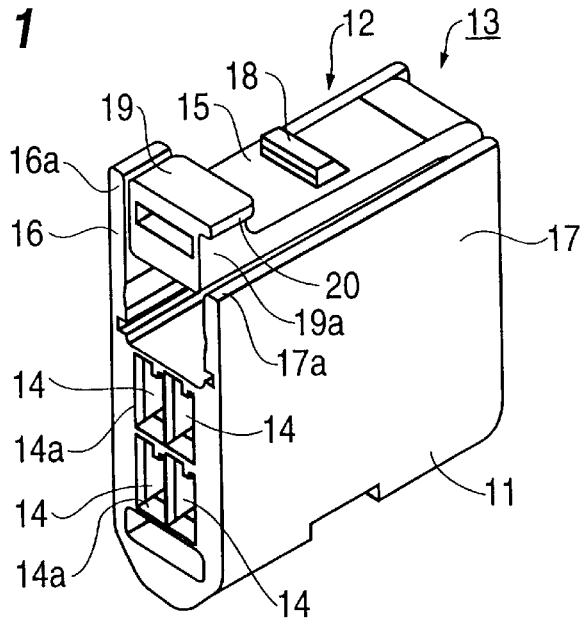
FIG. 1 shows a perspective view of a connector according to a specific embodiment of the invention.

As shown in FIG. 1, a connector 13 has a connector housing 11 and a locking member 12 located on the upper face of the connector housing 11; accordingly, when a corresponding connector (not shown) is fitted, the connectors 13 are latched together in a conventional manner.

Figure 2:
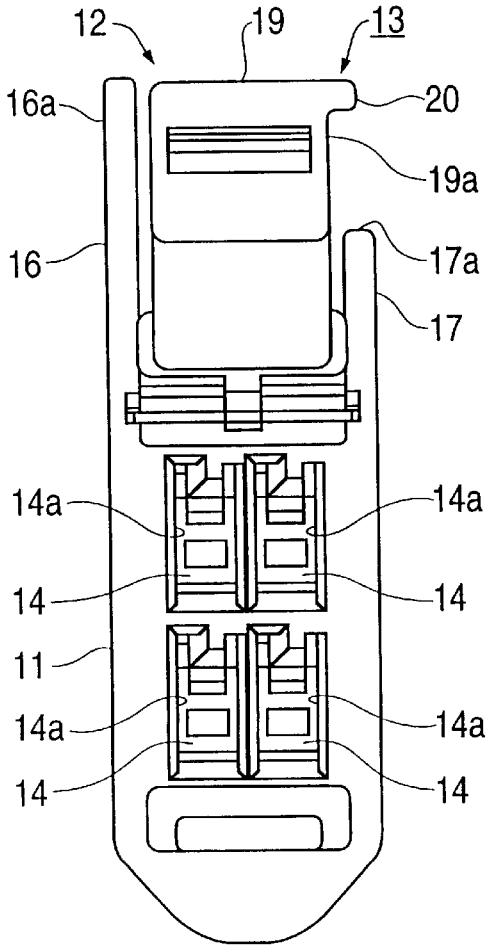
FIG. 2 shows a rear elevation of the connector of FIG. 1.
Figure 3:
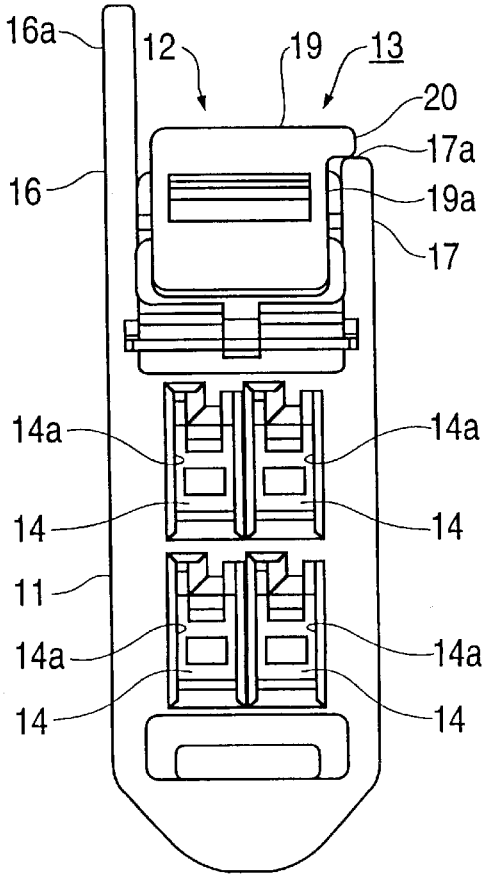
FIG. 3 shows a rear elevation of the connector of FIG. 1 showing a locking arm of the connector in a stopped position.
Figure 4:
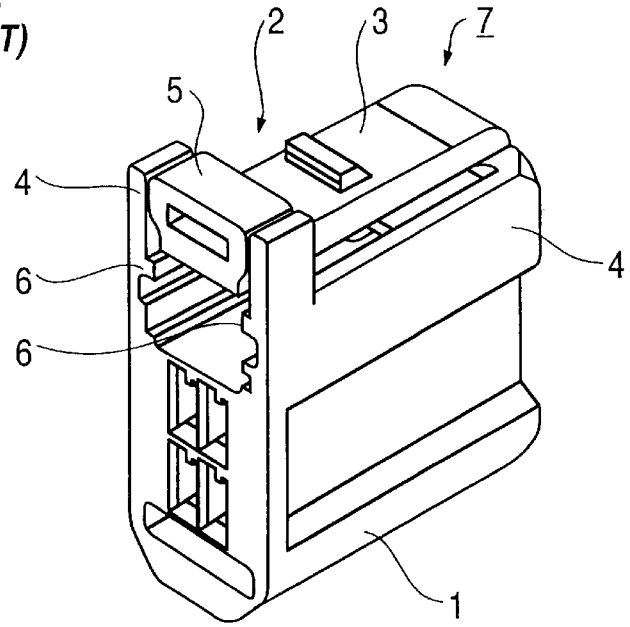
FIG. 4 (PRIOR ART)
FIG. 4 shows a perspective view of a conventional connector with a locking arm.
Figure 5:
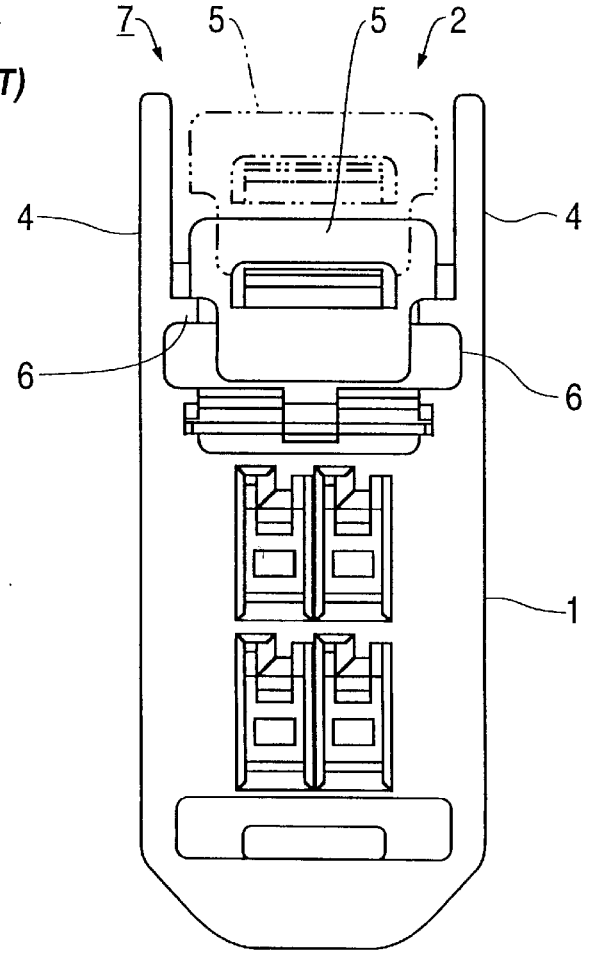
FIG. 5 (PRIOR ART)
FIG. 5 shows a rear elevation of the connector of FIG. 4.

As shown in FIG. 2, the connector housing 11 has a generally cuboidal shape, and terminal insertion chambers 14 formed in four places, to the left and right, above and below. Further, each terminal insertion chamber 14 has a female terminal fitting installed therein. Moreover, the anterior and posterior side faces of each terminal insertion chamber 14 are open. The opening towards the posterior face (in FIG. 2, the front face) forms a terminal installation opening 14*a* for installing a female terminal fitting into the terminal insertion chamber 14. The opening (not shown) located towards the anterior face (in FIG. 2, the rear face) forms a terminal insertion opening for the insertion of a corresponding male terminal fitting. The female terminal fitting, although not shown, is a commonly used female terminal fitting and comprises: a resilient contact member that is formed in an angular tubular shape and which can make contact with the male terminal fitting; and a barrel member fixed by crimping to a terminal end of an electric wire.

As shown in FIG. 1, the locking member 12 comprises a flexible locking arm 15 and controlling walls 16 and 17 located on respective sides of the arm 15. The locking arm 15 is formed at the anterior end on the upper face (in FIG. 1, located in the top right corner) of the connector housing 11 so as to be bendable in a vertical plane as illustrated in FIG. 1 by being supported at one end. Moreover, a fitting projection 18 is provided approximately in the central portion of the upper face of the locking arm 15. When the connector housing 11 is fitted with the corresponding connector housing (not shown), the fitting projection 18 fits into a fitting receiving member located in the corresponding connector housing. In this way, both the connectors are latched in a fitted state. The posterior end, that is, the free end of the locking arm 15 (in FIG. 1, located towards the left) has a releasing member 19 formed so as to project slightly in the upward direction. When the releasing member 19 is pressed downwards, the locking arm 15 bends, the fitting projection 18 is released from the fitting receiving member of the other connector, and the connectors are released from the latched state.

As shown in FIG. 2 the releasing member is constituted by a finger plate, and the right side portion of the releasing member 19 is undercut, excluding the finger plate, thereby defining a recess 19*a*. The controlling wall 17, to be described later, is arranged to co-operate with the recess 19*a*. That is, the controlling wall 17, to be described further on, can be located within the width dimension of the locking arm 15. Moreover, the upper right end of the releasing member 19 (the finger plate), which projects towards the right due to the recessing of the releasing member 19, constitutes a fitting member 20 that can make contact with the upper end of the controlling wall 17.

As shown in FIG. 2, the controlling walls 16 and 17 are located to the left and right of the locking arm 15 so as to fit snugly therewith. These controlling walls 16 and 17 are formed by causing the left and right side end portions of the connector housing 11 to project. The upper end portions of the controlling walls 16 and 17 extend up to the height of the lower face of the locking arm 15 when the locking arm 15 is in a natural state (the state shown in FIG. 2) and restrict movement of the locking arm 15 to the left or to the right.

The posterior end (the anterior face in FIG. 2) of the guide wall 16 shown on the left side in FIG. 2 extends up to the height of the upper face of the locking arm 15 when the locking arm 15 is in the natural state and forms a protecting wall 16*a* that prevents inadvertent operation of the releasing member 19. Furthermore, the upper edge of the posterior portion of the controlling wall 17 shown towards the right in the centre in FIG. 2 (in the diagram, this is the anterior face side) is formed so that the fitting member 20 of the releasing member 19 makes contact therewith before the locking arm 15 reaches its elastic limit when it is bent. That is, the upper edge of the posterior portion of the controlling wall 17 shown in FIG. 2 forms a controlling edge 17*a* that prevents excessive bending of the locking arm 15.

Next, the operation of the present embodiment is explained. In order to separate the two fitted connectors the latch is first released. In order to do this, the finger plate of the releasing member 19 is pressed down using a finger; this causes the locking arm 15 to bend and the fitting projection 18 to separate from the fitting receiving member of the corresponding connector. Then, in this state, the connectors are pulled apart to separate the connectors. At this time, when the latch is released, the locking arm 15 bends in a downward direction and thereby changes position. After the posterior end of the controlling wall 17 has entered the recess 19*a* of the releasing member 19, the fitting projection 20 makes contact with the controlling edge 17*a*, which constitutes the upper edge of the controlling wall 17 (see FIG. 3). As a result, the bending of the locking arm 15 beyond this extent is prevented.

In this way, in the present embodiment, it has been arranged so that the controlling wall 17 is located within the minimum width of the locking arm 15 and the upper edge (the controlling edge 17*a*) of the controlling wall 17 functions as a stopper against excessive bending. Accordingly, the connector 13 can be miniaturized compared to the conventional case where a stopper is formed independently of a controlling wall, and controlling walls are provided on the outer sides of the locking arm 15. Specifically, if the width of the upper face (the portion pressed down) of the releasing member 19 is set to be the same dimension as that of the locking arm 15, then, compared to the conventional case where the controlling wall is provided outside the releasing member, the width of the connector housing 11 can be reduced approximately to the extent of the thickness of the controlling wall 17. Since finger access is now possible from the side it may be possible to reduce the width of the locking arm to less than the conventional connector.

Moreover, since the bending operation range of the locking arm 15 to the left and to the right is restricted by means of the controlling walls 16 and 17, external objects like electric wires do not easily get cut into by being trapped under the locking arm 15. This ensures that the locking arm 15 can operate smoothly. Furthermore, since a protecting wall 16*a* is provided on one of the controlling walls 16, inadvertent pressing of the releasing member 19 during the locked state is prevented.

The present invention is not limited to the embodiment described above and may, for example, be varied and embodied as described below. These embodiments also lie within the technical range of the present invention.

Although in the above embodiment the configuration is such that the cut-away member 19*a* is formed on the right side of the releasing member 19 and the controlling wall 17 enters the right side of the releasing member 19 when the locking arm 15 bends and changes shape, it may equally be arranged so that, in the same manner, a cut-away member is also formed on the left side of the releasing member, and the controlling wall on the left side has no protecting wall and enters this cut-away member when the locking arm bends. Accordingly, the left controlling wall also no longer needs to be located outside the releasing member, and the width of the connector housing can be further reduced. In this case, the width of the connector housing approximately equals that of the releasing member and other means may be provided to protect the locking arm against inadvertent release.

I claim:

1. An electrical connector comprising: a housing and a cantilever locking arm secured to said housing, said housing including first and second sidewalls which define a width of the connector and a transverse wall interconnecting said sidewalls, each sidewall extending beyond said transverse wall to define an outer edge, the outer edge of the second sidewall being spaced farther from the transverse wall than the outer edge of the first sidewall, said locking arm being movable towards said transverse wall of the housing against a resilient bias for locking engagement with a mating connector, said locking arm having an inner side facing said transverse wall, said locking arm being positioned generally between said sidewalls, said inner side of said locking arm being generally between said transverse wall and said outer edges when not depressed, and said locking arm further including a portion which at least partially overlaps the outer edge of said first sidewall for abutting said outer edge of said first sidewall when said locking arm is depressed, whereby the width of the connector is reduced.

2. A connector in accordance with claim 1 wherein said locking arm includes an outer side opposite said inner side, and said outer edge of said second sidewall is spaced away from said transverse wall at least as far as said outer side of said locking arm when said locking arm is not depressed.

3. A connector in accordance with claim 1 wherein said locking arm includes a free end, and said portion that at least partially overlaps said outer edge of said first sidewall is defined by a laterally projecting plate portion positioned at only the free end of the locking arm.

4. A connector in accordance with claim 1 wherein said housing and said locking arm are formed as a one-piece plastic member.

* * * * *